US011371810B2

(12) United States Patent
Norris et al.

(10) Patent No.: US 11,371,810 B2
(45) **Date of Patent: *Jun. 28, 2022**

(54) SEAL-CARRYING ENTANGLING PROJECTILES AND SYSTEMS FOR THEIR USE

(71) Applicant: Wrap Technologies, Inc., Las Vegas, NV (US)

(72) Inventors: Elwood Norris, Poway, CA (US); John Bailey, Poway, CA (US); Jerry Hardy, Las Vegas, NV (US)

(73) Assignee: Wrap Technologies, Inc., Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/079,695

(22) Filed: Oct. 26, 2020

(65) Prior Publication Data

US 2021/0231412 A1 Jul. 29, 2021

Related U.S. Application Data

(63) Continuation-in-part of application No. 16/502,921, filed on Jul. 3, 2019, now Pat. No. 10,852,114.

(60) Provisional application No. 63/038,714, filed on Jun. 12, 2020, provisional application No. 62/693,575, filed on Jul. 3, 2018.

(51) Int. Cl.
*F41H 13/00* (2006.01)
*F42B 12/66* (2006.01)

(52) U.S. Cl.
CPC ..... *F41H 13/0006* (2013.01); *F42B 12/66* (2013.01)

(58) Field of Classification Search
CPC ..... F42B 12/66; F42B 15/10
USPC ..... 102/502, 504
See application file for complete search history.

(56) References Cited

U.S. PATENT DOCUMENTS

| | | | |
|---|---|---|---|
| 34,626 | A | 3/1862 | Ely |
| 34,628 | A | 3/1862 | Gault |
| 35,734 | A | 6/1862 | Gault |
| 39,282 | A | 7/1863 | Ganster |
| 271,825 | A | 2/1883 | Fiske |
| 347,988 | A | 8/1886 | Boyd |
| 1,070,582 | A | 8/1913 | Browning |
| 1,151,070 | A | 8/1915 | Victory |
| 1,198,035 | A | 9/1916 | Huntington |

(Continued)

FOREIGN PATENT DOCUMENTS

| | | | |
|---|---|---|---|
| CA | 2162221 | A1 | 5/1996 |
| CN | 104085851 | A | 10/2014 |

(Continued)

OTHER PUBLICATIONS

European Search Report Application No. 17824657.5-1011, dated Apr. 11, 2019; 9 Pages.

(Continued)

*Primary Examiner* — Bret Hayes
(74) *Attorney, Agent, or Firm* — Jason Jones

(57) ABSTRACT

An entangling projectile includes a pair of pellets and a tether connecting the pellets. The pellets each have a head portion and a tail portion. At least one gasket is carried by the head portion of at least one of the pellets. The gasket is operable to provide a sealed interface between the head portion of the at least one pellet and a socket within which the at least one pellet is fired from a launcher.

30 Claims, 10 Drawing Sheets

(56) References Cited

U.S. PATENT DOCUMENTS 1,211,001 A 1/1917 Steinmetz
1,217,415 A 2/1917 Colomyjczuk
1,229,421 A 6/1917 Downs
1,276,689 A 8/1918 Poudrier
1,304,857 A 5/1919 Davis
1,343,747 A 6/1920 Radakovich
1,488,182 A 3/1924 Whelton
1,536,164 A 5/1925 Tainton
2,354,451 A 7/1944 Forbes
2,372,383 A 3/1945 Lee
2,373,363 A 4/1945 Wellcome
2,373,364 A 4/1945 Wellcome
2,455,784 A 12/1948 Lapsensohn
2,611,340 A 9/1952 Manning
2,668,499 A 2/1954 Mourlaque
2,797,924 A 7/1957 Stewart
3,085,510 A 4/1963 Campbell
3,340,642 A 9/1967 Vasiljevic
3,484,665 A 12/1969 Mountjoy et al.
3,523,538 A 8/1970 Shimizu
3,583,087 A 6/1971 Huebner
3,717,348 A 2/1973 Bowers
3,773,026 A 11/1973 Romero
3,803,463 A 4/1974 Cover
3,831,306 A 8/1974 Gregg
3,921,614 A 11/1975 Fogelgren
4,027,418 A 6/1977 Baldie et al.
4,166,619 A 9/1979 Bergmann et al.
4,193,386 A 3/1980 Rossi
4,253,132 A 2/1981 Cover
4,318,389 A 3/1982 Kiss Jr.
4,466,417 A 8/1984 Mulot et al.
4,559,737 A 12/1985 Washington
4,656,947 A 4/1987 Gordon et al.
4,664,034 A 5/1987 Christian
4,750,692 A 6/1988 Howard
4,752,539 A 6/1988 Vatter
4,912,867 A 4/1990 Dukes, Jr.
4,912,869 A 4/1990 Govett
4,962,747 A 10/1990 Biller
5,003,886 A 4/1991 Pahnke et al.
5,078,117 A 1/1992 Cover
5,103,366 A 4/1992 Battochi
5,145,187 A 9/1992 Lewis
5,279,482 A 1/1994 Dzenitis et al.
5,314,196 A 5/1994 Ruelle
5,315,932 A 5/1994 Bertram
5,326,101 A 7/1994 Fay
5,372,118 A 12/1994 Schmidt, III et al.
5,396,830 A 3/1995 Kornblith et al.
5,460,155 A 10/1995 Hobbs, II
5,561,263 A 10/1996 Baillod
5,649,466 A 7/1997 Genovese
5,654,867 A 8/1997 Murray
5,698,815 A 12/1997 Ragner
5,706,795 A 1/1998 Gerwig
5,750,918 A 5/1998 Mangolds et al.
5,782,002 A 7/1998 Reed
5,786,546 A 7/1998 Simson
5,814,753 A 9/1998 Rieger
5,831,199 A 11/1998 McNulty, Jr. et al.
5,898,125 A 4/1999 Mangolds et al.
5,904,132 A 5/1999 Biller
5,943,806 A 8/1999 Underwood
5,962,806 A 10/1999 Coakley et al.
5,996,504 A 12/1999 Lowery
6,283,037 B1 9/2001 Sclafani
6,381,894 B1 5/2002 Murphy
6,382,071 B1 5/2002 Bertani
6,543,173 B1 4/2003 Golan
6,575,073 B2 6/2003 McNulty, Jr. et al.
6,615,622 B2 9/2003 MacAleese et al.
6,636,412 B2 10/2003 Smith
6,729,222 B2 5/2004 McNulty, Jr.
6,820,560 B1 11/2004 Romppanen
6,880,466 B2 4/2005 Carman
6,898,887 B1 5/2005 Stratbucker
6,957,602 B1 * 10/2005 Koenig ..... B64D 7/00 102/502
7,042,696 B2 5/2006 Smith et al.
7,065,915 B2 6/2006 Chang
7,075,770 B1 7/2006 Smith
7,114,450 B1 10/2006 Chang
7,143,539 B2 12/2006 Cerovic et al.
7,218,501 B2 5/2007 Keely
7,237,352 B2 7/2007 Keely et al.
7,314,007 B2 1/2008 Su
7,327,549 B2 2/2008 Smith et al.
7,412,975 B2 8/2008 Burton, Jr.
7,444,939 B2 11/2008 McNulty et al.
7,444,940 B2 11/2008 Kapeles et al.
7,640,839 B2 1/2010 McNulty, Jr.
7,640,860 B1 1/2010 Glover et al.
7,673,411 B1 3/2010 Baldwin
7,686,002 B2 3/2010 Andrews
7,778,005 B2 8/2010 Saliga
7,791,858 B2 9/2010 Hummel et al.
7,856,929 B2 12/2010 Gavin et al.
7,859,818 B2 12/2010 Kroll et al.
7,900,388 B2 3/2011 Brundula et al.
7,905,180 B2 3/2011 Chen
7,950,176 B1 5/2011 Nemtyshkin
7,950,329 B1 5/2011 Nemtyshkin et al.
7,984,676 B1 7/2011 Gavin et al.
8,015,905 B2 9/2011 Park
8,024,889 B2 9/2011 Bunker
8,082,199 B2 12/2011 Kwok
8,141,493 B1 3/2012 Kuchman
8,186,276 B1 5/2012 Olden et al.
8,231,474 B2 7/2012 Stethem
8,245,617 B2 8/2012 Martinez et al.
8,261,666 B2 9/2012 Garg
8,281,776 B2 10/2012 Körver et al.
8,339,763 B2 12/2012 McNulty, Jr.
8,441,771 B2 5/2013 Hinz et al.
8,547,679 B2 10/2013 Gavin
8,561,516 B2 10/2013 Martinez et al.
8,601,928 B2 12/2013 Martinez et al.
8,671,841 B2 3/2014 Raquin et al.
8,695,578 B2 4/2014 Olden et al.
8,677,675 B2 5/2014 Koch
8,757,039 B2 6/2014 Martinez et al.
8,857,305 B1 10/2014 Tseng
8,881,654 B2 11/2014 Seecamp
8,896,982 B2 11/2014 Beecher et al.
8,899,139 B2 12/2014 Brill et al.
9,025,304 B2 5/2015 Brundula et al.
9,134,099 B2 9/2015 Tseng
9,157,694 B1 10/2015 Tseng
9,220,246 B1 12/2015 Roman
9,255,765 B2 2/2016 Nelson
9,303,942 B2 4/2016 Sievers
9,335,119 B2 5/2016 Werner
9,414,578 B2 8/2016 Thornbrough
9,435,619 B1 9/2016 Park
9,581,417 B2 2/2017 Tseng
9,638,498 B2 5/2017 Chang
10,107,599 B2 10/2018 Norris et al.
10,551,152 B2 2/2020 Norris
10,852,114 B2 * 12/2020 Norris ..... F41B 15/10
2002/0134365 A1 9/2002 Gray
2002/0170418 A1 11/2002 McNulty Jr et al.
2003/0106415 A1 6/2003 Smith
2003/0165041 A1 9/2003 Stethem
2003/0165042 A1 9/2003 Stethem
2004/0245338 A1 12/2004 Poloniewicz
2005/0166441 A1 8/2005 Mattox
2006/0112574 A1 6/2006 Hodge et al.
2006/0120009 A1 6/2006 Chudy, II
2006/0254108 A1 11/2006 Park
2007/0019358 A1 1/2007 Kroll
2007/0101893 A1 5/2007 Shalev et al.
2007/0264079 A1 11/2007 Martinez et al.

(56) References Cited

U.S. PATENT DOCUMENTS

| | | | | |
|---|---|---|---|---|
| 2009/0025597 | A1* | 1/2009 | Kapeles | F41H 13/0025 102/464 |
| 2009/0084284 | A1 | 4/2009 | Martinez et al. | |
| 2010/0126483 | A1 | 5/2010 | Makowski | |
| 2010/0315756 | A1 | 12/2010 | Gavin | |
| 2011/0005373 | A1 | 1/2011 | Martinez et al. | |
| 2011/0271825 | A1 | 11/2011 | Howland | |
| 2012/0019975 | A1 | 1/2012 | Hanchett et al. | |
| 2012/0170167 | A1 | 7/2012 | Beechey et al. | |
| 2012/0210904 | A1 | 8/2012 | Merems | |
| 2014/0331984 | A1 | 11/2014 | Brahler, II et al. | |
| 2014/0334058 | A1 | 11/2014 | Galvan et al. | |
| 2015/0075073 | A1 | 3/2015 | Sylvester | |
| 2015/0168107 | A1 | 6/2015 | Tseng | |
| 2015/0241180 | A1 | 8/2015 | Pruett | |
| 2015/0276351 | A1 | 10/2015 | Pekarek et al. | |
| 2015/0316345 | A1 | 11/2015 | Brahler, II et al. | |
| 2016/0010949 | A1 | 1/2016 | Teetzel et al. | |
| 2016/0161225 | A1 | 6/2016 | Searle et al. | |
| 2016/0238350 | A1 | 8/2016 | Tseng | |
| 2017/0029816 | A1 | 2/2017 | Swiderski | |
| 2017/0160060 | A1 | 6/2017 | Purvis | |
| 2017/0241751 | A1 | 8/2017 | Nerheim | |
| 2017/0276460 | A1 | 9/2017 | Norris et al. | |
| 2017/0276461 | A1 | 9/2017 | Norris | |
| 2018/0003462 | A1 | 1/2018 | Chavez | |
| 2018/0292172 | A1 | 10/2018 | Ehrlich | |
| 2018/0372456 | A1 | 12/2018 | Norris | |
| 2020/0072584 | A1 | 3/2020 | Ozanne | |
| 2020/0096297 | A1 | 3/2020 | Norris | |

FOREIGN PATENT DOCUMENTS

| | | | |
|---|---|---|---|
| DE | 3522661 | | 1/1987 |
| GB | 2386673 | A | 9/2003 |
| JP | 2011/106748 | | 6/2011 |
| RU | 2186492 | C2 | 8/2002 |
| RU | 2274823 | C1 | 4/2006 |
| RU | 2410625 | C2 | 1/2011 |

OTHER PUBLICATIONS

PCT Application No. PCT/US18/56068; Filing Date Oct. 16, 2018; Elwood Norris, International Search Report; dated Jan. 15, 2019; 11 Pages.

* cited by examiner

SEAL-CARRYING ENTANGLING PROJECTILES AND SYSTEMS FOR THEIR USE

PRIORITY CLAIM

Priority is claimed of and to U.S. Provisional Patent Application Ser. No. 63/038,714, filed Jun. 12, 2020, which is hereby incorporated herein by reference in its entirety: this application is a continuation-in-part of U.S. patent application Ser. No. 16/502,921, filed Jul. 3, 2019, which claims priority to U.S. Provisional patent Application Ser. No. 62/693,575, filed Jul. 3, 2018, each of which are hereby incorporated herein by reference in its entirety.

RELATED APPLICATIONS

This application is related to U.S. patent application Ser. No. 15/467,958, filed Mar. 23, 2017, issued as U.S. Pat. No. 10,107,599, which is hereby incorporated herein by reference in its entirety.

BACKGROUND OF THE INVENTION

Field of the Invention

The present invention relates generally to non-lethal, ranged weapons systems to aid in impeding or subduing hostile or fleeing persons of interest.

Related Art

It has been recognized for some time that police and military personnel can benefit from the use of weapons and devices other than firearms to deal with some hostile situations. While firearms are necessary tools in law enforcement, they provide a level of force that is sometimes unwarranted. In many cases, law enforcement personnel may wish to deal with a situation without resorting to use of a firearm. It is generally accepted, however, that engaging in hand-to-hand combat is not a desirable choice.

For at least these reasons, ranged engagement devices such as the Taser™ have been developed to provide an alternative. While such electrical muscular disruption ("EMD") weapons have been used with some success, debates continue as to whether such devices are as safe as claimed or are an appropriate level of force for many situations. Other ranged engagement solutions, such as mace or pepper spray, are very limited in range and are often criticized for the pain caused to subjects and the potential for such solutions to affect police or bystanders.

As such, designers continue to seek non-lethal solutions that can be effectively used by police or law enforcement especially to impede or subdue fleeing subjects.

SUMMARY OF THE INVENTION

In accordance with one aspect of the invention, an entangling projectile is provided, including a pair of pellets and a tether connecting the pellets. The pellets can each have a head portion and a tail portion. At least one gasket can be carried by the head portion of at least one of the pellets. The gasket is configured to or is operable to provide a sealed interface between the head portion of the at least one pellet and a socket within which the at least one pellet is fired from a launcher.

In accordance with another aspect of the technology, a system for launching an entangling projectile is provided, including an entangling projectile, including a pair of pellets and a tether connecting the pellets. The pellets can each have a head portion and a tail portion. A projectile casing can include a pair of sockets, each socket sized to carry one of the pair of pellets, and a selectively activatable pressure source, carried by the projectile casing, the pressure source being capable of expelling the entangling projectile from the projectile casing toward a subject. At least one gasket can be carried by the head portion of at least one of the pellets, the gasket suitable to provide a sealed interface between the head portion of the at least one pellet and a socket within which the at least one pellet is carried in the launcher.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
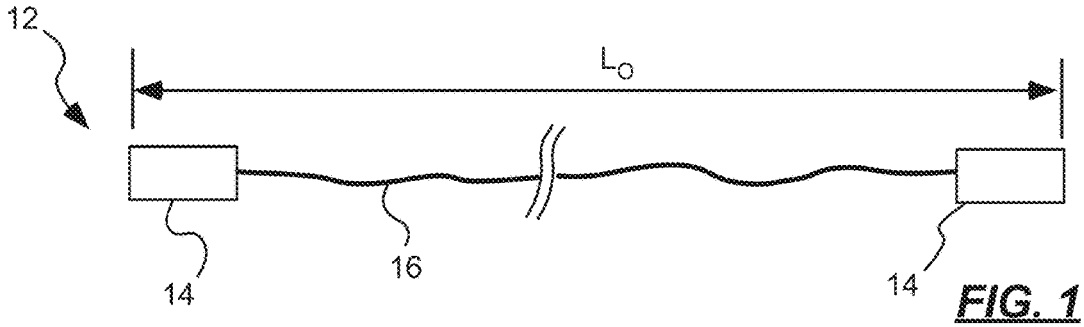
FIG. 1 is a front view of an entangling projectile extended substantially to its full length in accordance with an embodiment of the invention.
Figure 2A:
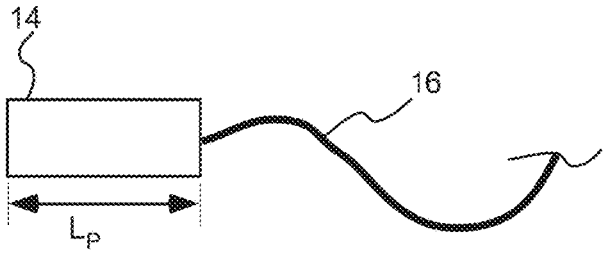
FIG. 2A is a front view of a pellet and a portion of a tether of the projectile of FIG. 1.
Figure 2B:
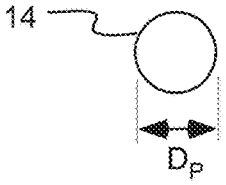
FIG. 2B is an end view of the pellet of FIG. 2A.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a pellet" can include one or more of such pellets, if the context so dictates.

As used herein, the terms "firearm blank" or "blank cartridge" refer to the well-known blank cartridge that can be used with firearms. Such blank cartridges contain gunpowder but not a bullet or shot: as such, they can be discharged to produce only a high velocity pressure wave, without an accompanying shot or slug.

As used herein, the term "gasket" is understood to refer to a component that provides a seal between two or more other components. Gaskets referenced herein are generally formed from a pliable, ductile or compressible material. Examples of suitable materials for gaskets include, without limitation, rubber, Buna rubber, polybutadiene rubber, synthetic rubbers, neoprene, felt, fabrics, fibrous pads, and the like. Gaskets can be formed in a variety of shapes, including without limitation, toroidal shapes (e.g., "o-rings"), relatively flat disks, flat washers, etc. When conditions of gaskets are discussed herein, such reference can be made to the gasket when in an uncompressed condition, or a fully or partially compressed condition, as the discussion may dictate. Gaskets can be formed from a unitary material, or may include a frame formed from a differing material that carries the more pliable material.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

INVENTION

The present technology relates generally to non-lethal weapons systems, sometimes referred to as ensnarement or entanglement systems, that can be effectively used as an aid in impeding the progress of or detaining aggressive or fleeing subjects. Devices in accordance with the present technology can be advantageously used to temporarily impede a subject's ability to walk, run, or use his or her arms in cases where law enforcement, security personnel or military personnel wish to detain a subject, but do not wish to use lethal or harmful force or to engage in close proximity hand-to-hand combat. The technology provides a manner by which the arms or legs of a subject can be temporarily tethered or bound, to the extent that the subject finds it difficult to continue moving in a normal fashion.

While the present technology can be directed at any portion of a subject's body, the following discussion will focus primarily on use of the technology to temporarily tether or bind a subject's legs. It is to be understood, however, that the present technology is not limited to this application. In some cases, multiple portions of the subject's body can be targeted, such as both the arms and the legs.

As shown generally in FIGS. 1-5, the present technology provides an entangling projectile 12 that can be deployed toward a subject's legs to cause the projectile to wrap about the subject's legs. The projectile includes at least one flexible tether 16 and at least two pellets 14, coupled together by the tether. By engaging a subject with the entangling projectile, the subject is temporarily rendered partially or fully incapacitated and thereby restricted in his or her ability to flee or attack. The entangling projectiles of the present technology are launched toward a subject (100 in FIGS. 3A-4) by a launcher. In addition to the launchers discussed herein, numerous examples of suitable launchers are provided, as examples, in U.S. patent application Ser. No. 15/081,440, filed Mar. 25, 2016, issued as U.S. Pat. No. 10,036,615, which is hereby incorporated herein by reference in its entirety. Such launchers can include energy sources such as compressed gas, explosives/combustibles, mechanical springs, etc.

Generally speaking, a launcher for use with the present entangling projectiles will launch the projectile toward a subject 100 at a relatively high rate of speed. Typically, the projectile can be deployed toward a subject from a distance of between about 6 feet and about 30 feet (1.8 to 9.1 meters), and engages the subject within a matter of about 0.0075 to 0.0375 seconds (traveling at about 800 ft/sec (243.8 ms/)). After being deployed from the launcher, the entangling projectile will wrap about the subject's legs two or three or more times, causing the subject to be temporarily unable to effectively move. As the entangling projectile can be launched from some distance, law enforcement personnel can maintain a safe distance from a subject, yet still be able to effectively and safely temporarily restrain, disable or impede the subject.

Figure 4:
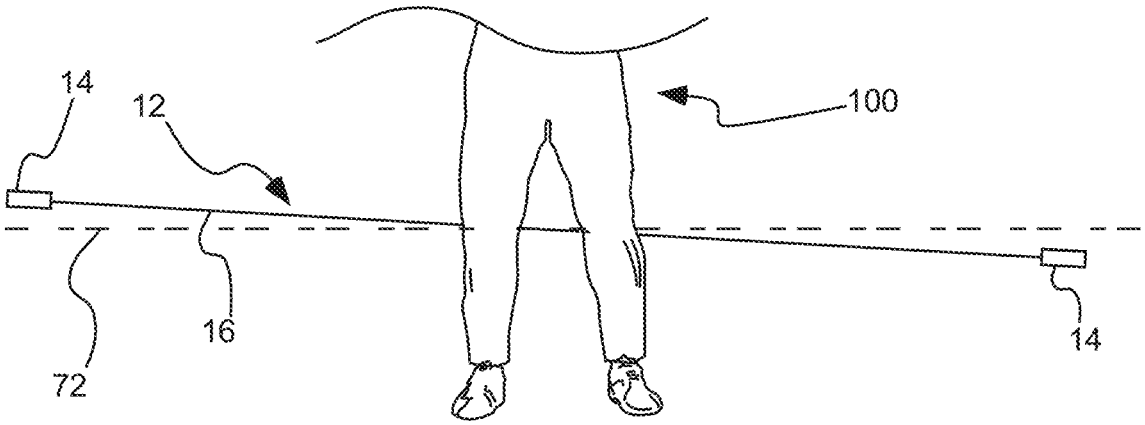
FIG. 4 is a front view of a portion of a subject in accordance with an embodiment of the invention, shown immediately prior to an entangling projectile engaging the subject's legs from behind.

Operation of the entangling projectile is shown generally in FIG. 4: after being released by a launcher, the projectile 12 travels toward the subject 100. As the projectile travels toward the subject, pellets 14 travel away from one another, resulting in the tether 16 being pulled substantially taught between the two. Once the projectile engages the subject (in the example shown in FIG. 4 the subject's legs are engaged), the pellets and tether wrap about the subject and thereby temporarily entangle and/or disable the subject.

A variety of differing pellet and tether combinations can be utilized in the present technology. In the examples shown in FIGS. 1-4, the projectile 12 is shown with two generic pellets 14 connected by a single tether 16. While more than two pellets can be utilized, the examples shown herein include only two. In some embodiments, the invention is limited to two, and only two, pellets connected by a single tether. In one aspect, the invention consists of two pellets and a single tether. In one aspect, the invention consists essentially of two pellets and a single tether. It has been found that limiting the number of pellets to two results in a more effective deployment system: the risk of tangling of the tether 16 is diminished and the pellets spread apart from one another much more cleanly and quickly after being deployed from the launcher. This results in a more consistent trajectory after deployment. This arrangement can also allow, with the proper launcher configuration, the projectiles to be more accurately directed toward a subject.

Figure 5:
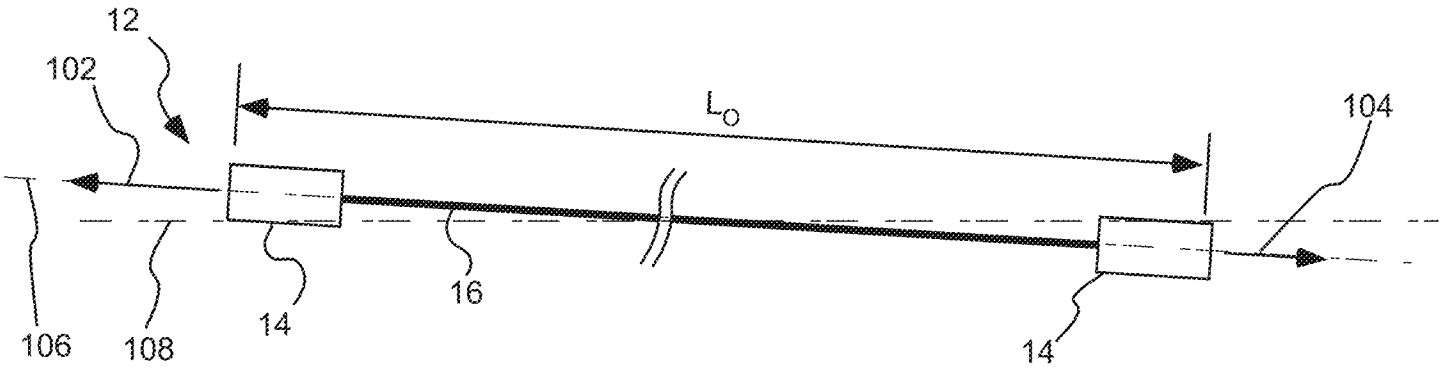
FIG. 5 is a front view of an entangling projectile in accordance with another embodiment of the invention, shown with the pellets pulling the tether into a taught condition.

FIG. 5 illustrates further features of the entangling projectile 12. As referenced above, the projectile includes two pellets 14 coupled on opposing ends of a tether 16. In this embodiment, two and only two pellets are provided, coupled by only a single tether 16. The pellets 14 can apply equal and opposite forces, shown by example with directional indicators 102 and 104, upon tether 16. In this manner, the tether is pulled into a taught, linear configuration by the force of the pellets traveling away from one another.

The tether 16 can include no additional structure coupled thereto, with no additional structure extending therefrom. In this manner, the pellets 14 can pull the tether into the straight, uninterrupted, linear configuration shown. The tether and pellets can occupy substantially a common plane 106 in the configuration immediately prior to contacting a subject. As shown, this plane 106 can be angularly offset from "true" horizontal 108, as the pellets are positioned at differing elevations prior to contact with the subject (as detailed further below). By omitting additional pellets or tethers, or other extraneous structure, the present technology can deliver an entangling projectile that engages subjects with a much higher rate of successful engagement.

FIG. 1 illustrates the projectile 12 extended to its full length "$L_O$." In one embodiment, the overall length of the tether is much longer than the size of pellets ($L_P$). The overall length can be on the order of seven feet (2.14 meters) or greater. The pellets can have a length "$L_P$" on the order of an inch (2.54 cm), and a diameter "$D_P$" on the order of ⅜ of an inch (0.95 cm). While differing embodiments of the technology can vary, it is generally desirable to maintain the pellets at a relatively small size to thereby limit the overall size requirements of the projectile casing that houses the pellets prior to deployment and to reduce the impact should a pellet hit the subject. In this manner, the technology can be provided in a lightweight, hand-held device.

The relationship of the pellet diameter, weight and length in relation to the tether length/weight can significantly affect the performance of the entangling projectile. It has been found that a pellet diameter of about 0.330 inches (0.84 cm) with a length of about 1 to 1.5 inches (2.54-3.81 cm) with a weight of about 5-6 grams combined with a tether of about 7 feet (2.13 m) weighing about 1 gram provides an effective entangling projectile. The present casing discussed below has been designed to effectively deliver such entangling projectiles with a high degree of precision and reliability.

Figure 6A:
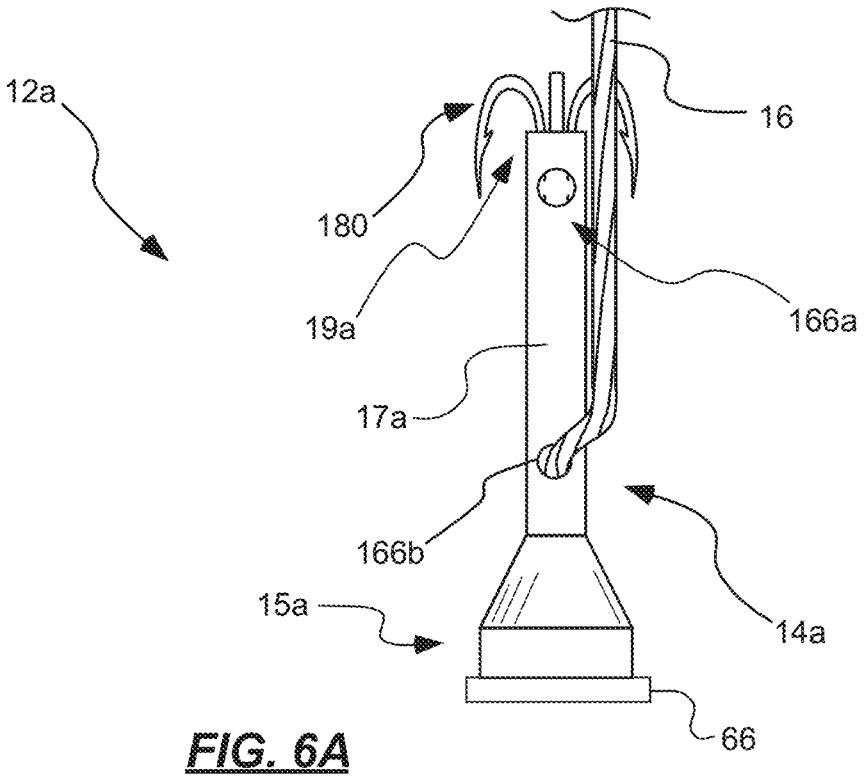
FIG. 6A is a side view of a portion of an entangling projectile in accordance with another embodiment of the invention.
Figure 6B:
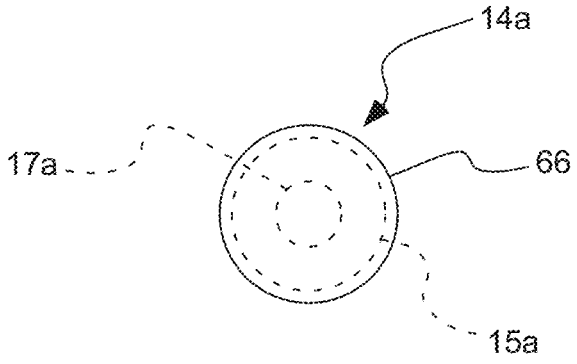
FIG. 6B is an end view of the entangling projectile of FIG. 6A.

FIGS. 6A and 6B illustrate a portion of one exemplary entangling projectile 12*a* in accordance with an embodiment of the invention. In this example, pellet 14*a* is provided that includes various features that aid in more accurately and effectively engaging a subject. A portion of tether 16 is shown extending from access hole 166*b*, which is generally formed in or through a shank 17*a* of the pellet. The tether can be secured to the shank by the use of adhesive applied through access hole 166*b*. A hook assembly 180 can be attached atop the shank of the pellet, and can be secured to the shank via application of adhesive through access hole 166*a*. Access holes 166*a* and 166*b*, which function much like rosettes, can be used to allow the hook structure or pellet to be coupled to the tether, or to one another. In the embodiment of FIG. 6, the hook assembly 180 can be positioned where desired, and a small amount of adhesive or other attachment material can be applied through access hole 166*a* to mount the hook assembly in position. Access hole 166*b* can be easily used in the same manner to mount the pellet 14*a* to the tether 16.

The pellet 12*a* can generally include a head portion 15*a*, a tail portion 19*a*, and a shank portion 17*a* intermediate the two. The head portion can include an outer diameter that is greater than a diameter of the shank portion. In other words, the pellet "necks down" from the head portion to the shank portion. As discussed in more detail below, a seal or gasket 66 can be carried by or coupled to the head portion: in this case, by a bottom or external surface of the head portion. The gasket can generally present a larger surface area than the bottom surface of the head portion, so that the gasket extends beyond the edges of the bottom surface.

While the present projectiles can be used with variety of launchers, FIGS. 7 through 12 illustrate one exemplary system that can be utilized to effectively direct the entangling projectile toward a subject. As shown in exploded view in FIG. 7, the projectile deployment system 40 generally includes an entangling projectile that includes a pair of pellets 14*a*, 14*b*, and a tether 16 connecting the pellets (note that the tether is omitted from many of these views to enable a more clear description of other components). A projectile casing 44 is provided that can include a pair of sockets 30*a*, 30*b* (see FIGS. 8, 10 and 11, for example). Each socket can be sized and shaped to carry one of the pair of pellets: in the examples shown, socket 30*a* carries pellet 14*a* and socket 30*b* carries pellet 14*b*.

The projectile casing 44 can include a selectively activatable pressure source 50 (FIGS. 9-12). The pressure source can be carried by the projectile casing, independently of the launcher or other components of the system. The pressure source can be capable of expelling the entangling projectile from the projectile casing toward a subject 100. The system can also include a launcher 42 that can carry an activator operable to activate the pressure source to expel the entangling projectile from the projectile casing toward the subject.

Figure 7:
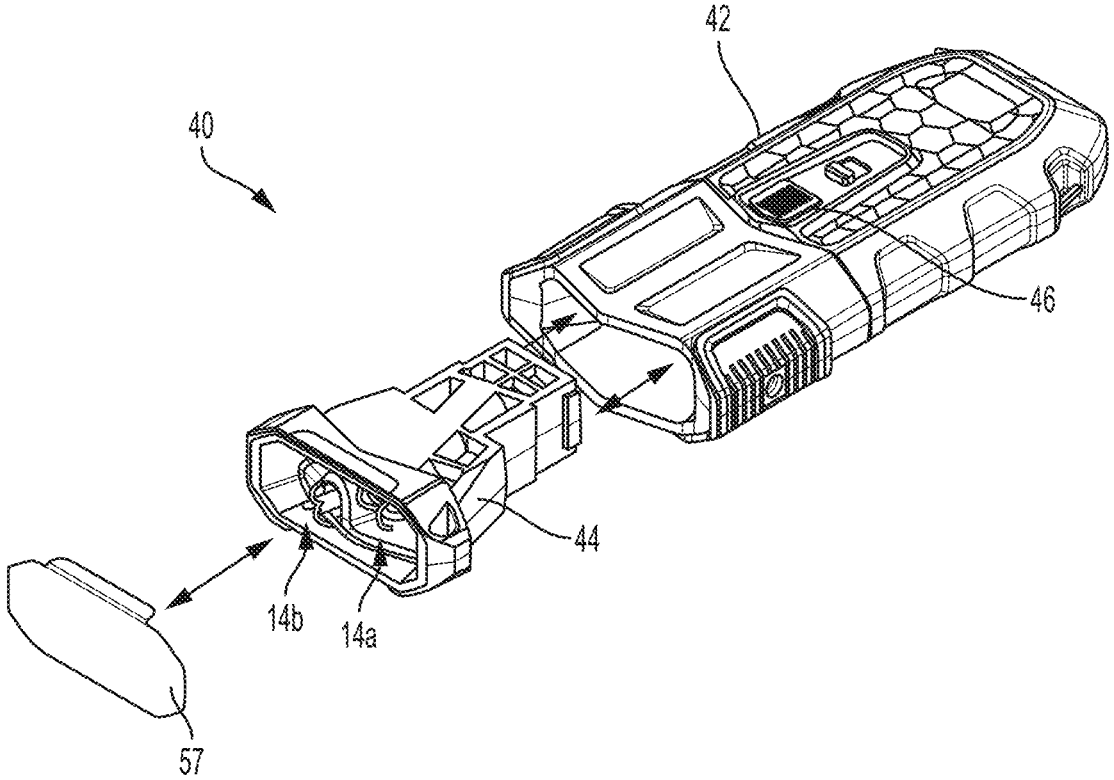
FIG. 7 is a perspective view of a projectile deployment system of the present invention, shown in an exploded condition with a projectile casing being removed from or installed in a launcher.
Figure 8:
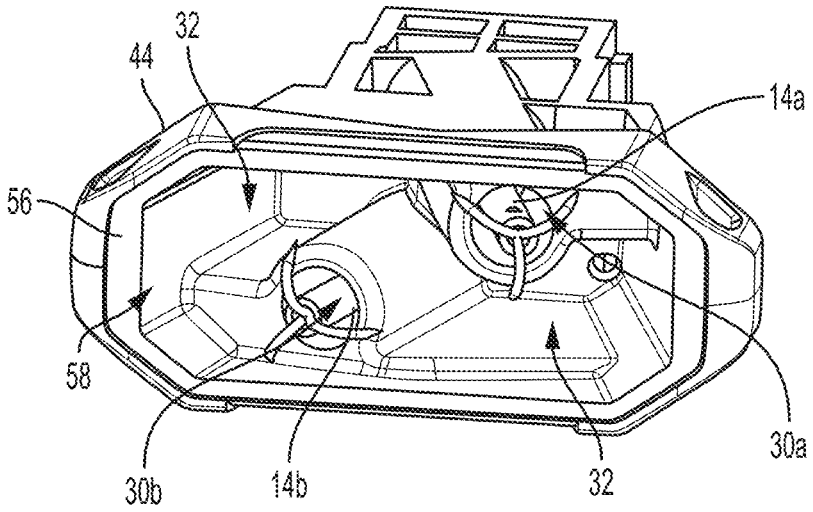
FIG. 8 is a front view of the projectile casing of FIG. 7.
Figure 9:
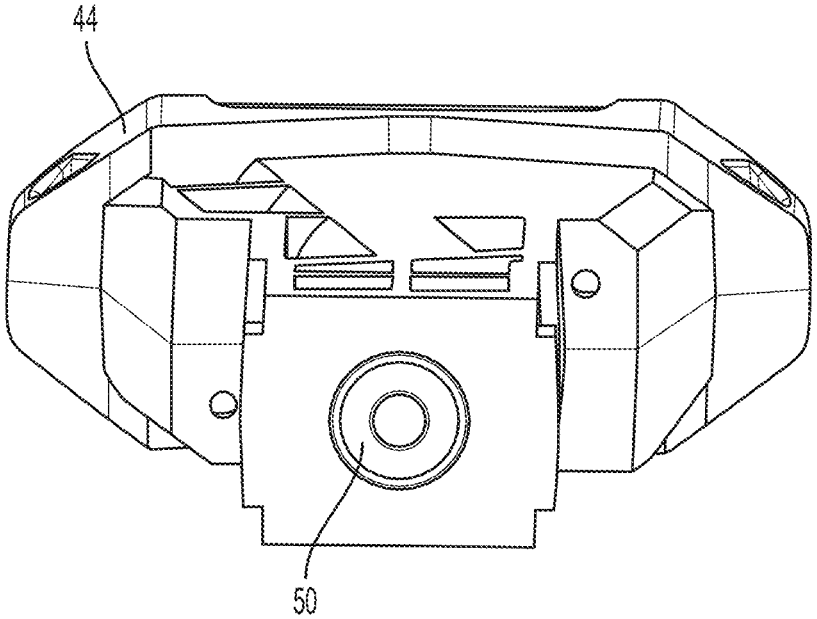
FIG. 9 is a rear view of the projective casing of FIG. 7.

FIG. 8 illustrates a front view of the casing 44. In this view, pellets 14*a*, 14*b* can be seen stored, ready for use, in sockets 30*a*, 30*b*, respectively. Tether storage compartments 32 can be provided and can consist of shaped depressions formed in the projectile casing to allow the tether (not shown in this view) to be stored adjacent the pellets prior to use. The projectile casing can include a front shroud 56 that can serve to create a protective pocket 58 around the tether and the pellets. As shown in FIG. 7, a cover 57 can be applied over the pocket 58 and can be attached to the shroud 56 to protect the pocket from exposure to contaminants and/or to contain the entangling projectile within the projectile casing.

In the examples shown in FIGS. 9-12, the pressure source 50 comprises a cartridge blank. This type of pressure source is well known to contain gunpowder that is typically activated by striking a primer formed in the cartridge. The blank cartridge contains no slug; deployment of the cartridge results only in a high-pressure wave being directed from the projectile casing. This high-pressure wave is utilized by the present technology to propel the entangling projectile from the system at high velocity. In another example, the pressure source can include a compressed gas source, such as a $CO_2$ gas cylinder or the like.

Figure 10:
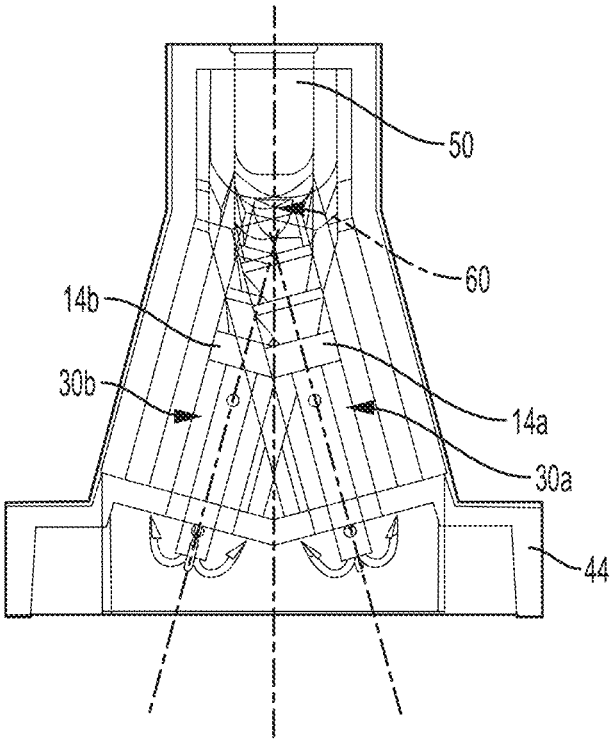
FIG. 10 is a top, partially sectioned view of the projectile casing of FIG. 7.

A shown in top view in FIG. 10, the sockets 30*a* and 30*b* can be angled relative to one another such that the pellets 14*a*, 14*b* travel apart from one another as they are expelled from the projectile casing 44. In the example shown, at least a portion of one of the sockets extends beneath a portion of another of the sockets within the cartridge (in this example, "bottom" socket 30*b* extends beneath "upper" socket 30*a*). Depending upon the particular arrangement, one of the pellets can overlap, or extend beneath or above, another of the pellets when the pellets are installed within the sockets. In the example shown, pellet 30*b* extends beneath (when viewed perpendicularly from a horizontal plane on which the casing sits) pellet 30*a* when the pellets are stored and ready for activation. As shown in side view in FIG. 11, in one example, the sockets can also be, or can alternatively be, vertically offset relative to one another and can extend in planes parallel to one another.

Figure 11:
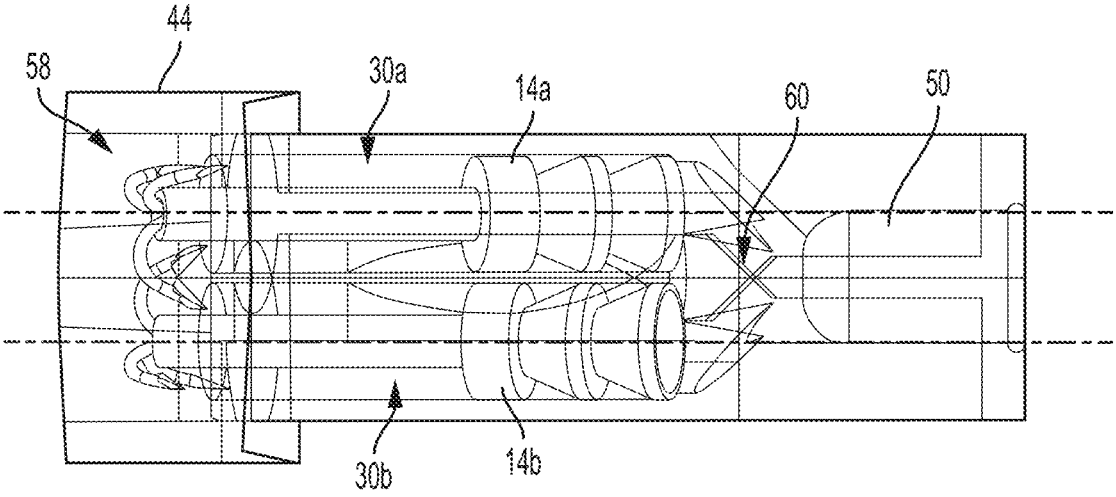
FIG. 11 is a side, partially sectioned view of the projectile casing of FIG. 7.
Figure 12:
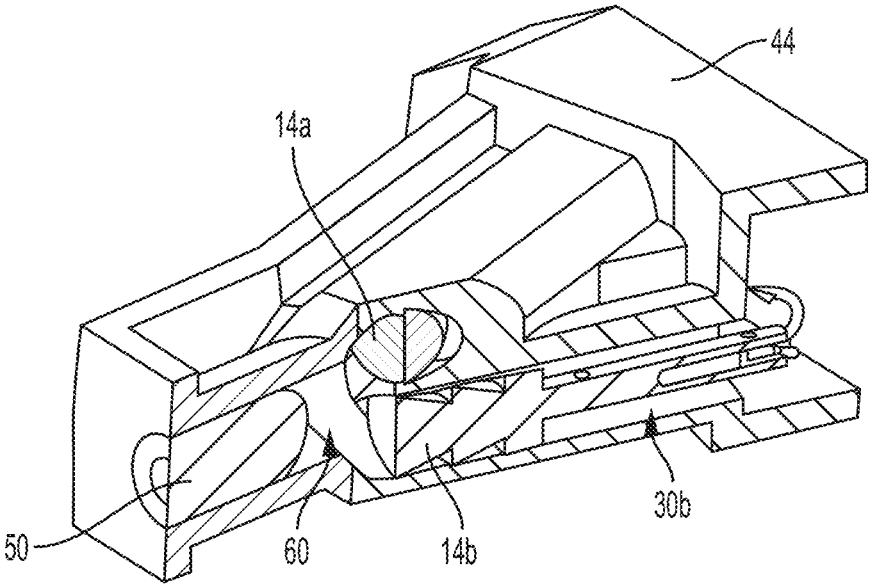
FIG. 12 is another side, partially sectioned view of the projectile casing of FIG. 7.
Figure 13A:
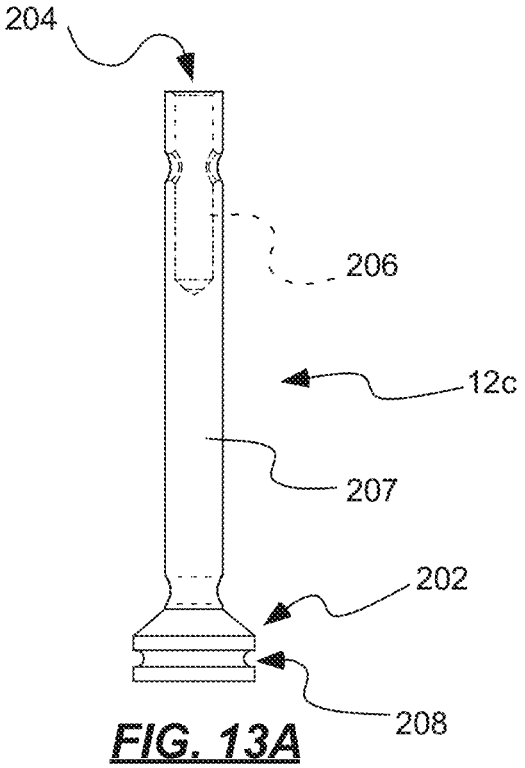
FIG. 13A is a front view of a pellet in accordance with an embodiment of the technology.
Figure 13B:
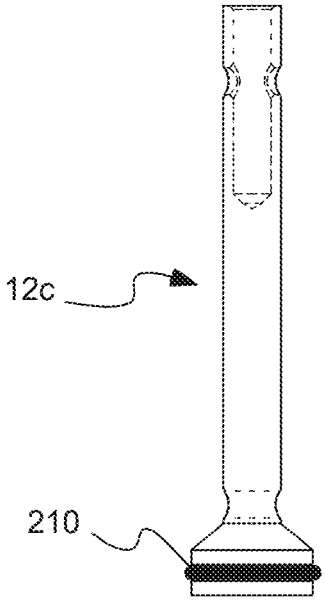
FIG. 13B is a front view of the pellet of FIG. 13A, with a gasket installed thereon.
Figure 14:
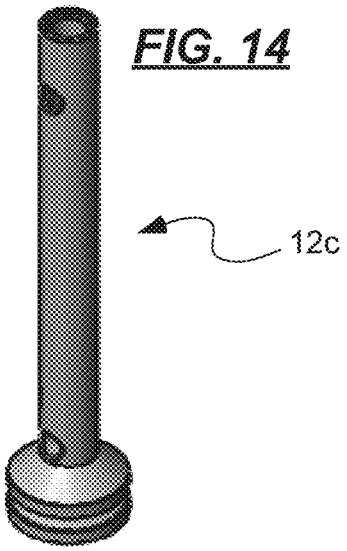
FIG. 14 is a perspective view of the pellet of FIG. 13A.
Figure 15:
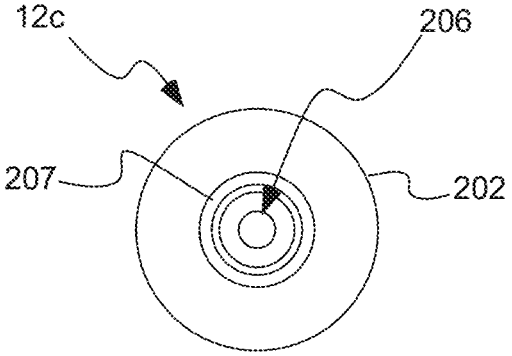
FIG. 15 is a top view of the pellet of FIG. 13A.
Figure 16:
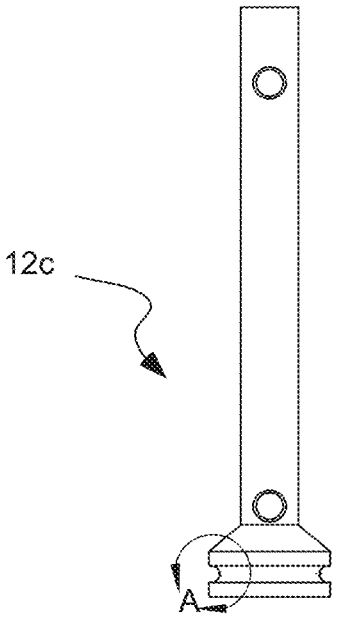
FIG. 16 is another front view of the pellet of FIG. 13A.
Figure 17:
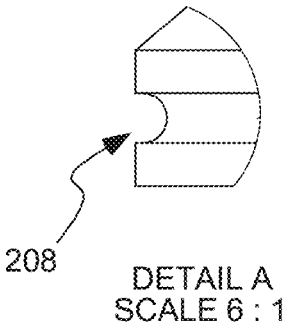
FIG. 17 is a more detailed view of Detail A of FIG. 16.

The casing 44 can also include a central bore 60, shown in FIGS. 10-12, located immediately adjacent the discharge end of pressure source or blank cartridge 50. In this embodiment, upon activation, the blank cartridge 50 discharges into the central bore a high-pressure wave. This high-pressure wave then travels into both sockets 30*a* and 30*b*, generally distributed equally among the two. Thus, each of socket 30*a* and socket 30*b* terminate into, or are at least in fluid communication with, central bore 60.

As discussed, each of socket 30*a*, 30*b* can hold one pellet, 14*a*, 14*b*, respectively, prior to deployment of the pellets from the projectile casing. As a high-pressure wave is generated by the cartridge, it is directed through the central bore and is applied to the pellets held in sockets 30*a*, 30*b*. The pellets are then forcibly expelled from the inner block toward the subject.

Figure 3A:
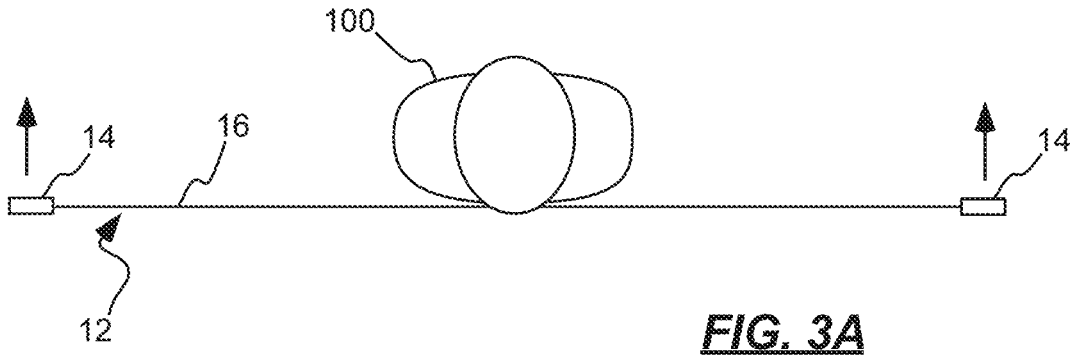
FIG. 3A is a top view of a subject toward which an entangling projectile was launched, shown immediately prior to the entangling projectile engaging the subject.
Figure 3B:
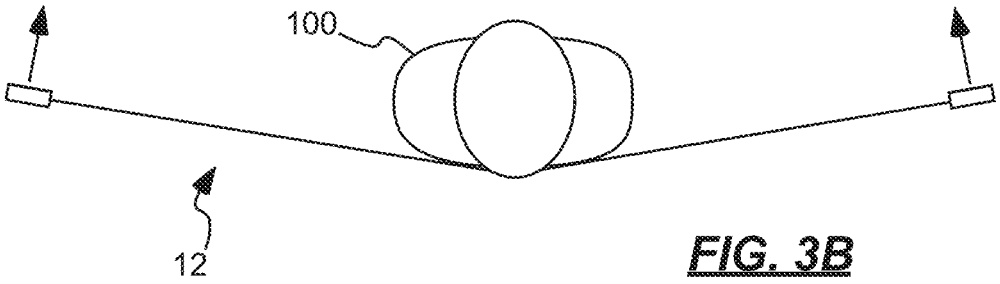
FIG. 3B is a top view of the subject and projectile of FIG. 3A, shown shortly after the entangling projectile engaged the subject.

The resulting launch is shown in FIGS. 3A and 3B. In FIG. 3A, the entangling projectile 12 has been launched toward the subject 100 (shown from above) and has traveled to engage the subject. Prior to contacting the subject, the tether 16 has been pulled taut, such that the pellets 14 are travelling in a linear direction toward the subject. Immediately after the tether 16 contacts the subject, the momentum of the pellets, prevented by the tether from continuing along their present trajectory, causes them to begin moving toward one another (shown in FIG. 3B), which momentum will cause the pellets to orbit about the subject.

As the pellets orbit about the subject's legs, the tether wraps itself tightly about the subject's legs. Note that, as the tether wraps about the subject's legs, the rotational velocity of the pellets will increase, causing them to wrap more quickly as the effective length of the tether is decreased. In an average deployment, the pellets will wrap themselves about the subject's legs 2-3 times, resulting in the tether being wrapped about the subject's legs 4-6 times. As will be appreciated, a subject will at least temporarily have great difficulty moving after the tether is thus wrapped about his or her legs.

Turning now to FIGS. 13A through 17, an additional embodiment of the technology includes a pellet 12*c* that provides improved functionality to the system. In this example, the pellet includes a head portion 202 and a tail portion 204. At least one seal or gasket (210 in FIG. 13B) can be carried by at least one of the pellets. The gasket can be sized and shaped to provide a sealed interface between the tail portion of the at least one pellet and a socket (e.g., 30*a*, 30*b*, above) within which the at least one pellet is fired from the launcher 40.

The gasket or seal provided about the tail portion can be configured in a number of manners. In one aspect, a recess or groove 208 is formed in the head portion of the pellet, and the gasket can be fitted within the recess or groove. In other aspects, the seal can be carried by an end of the tail portion of the pellet, and slightly overlap the edges thereof (see, for example, FIGS. 6A and 6B, discussed in more detail below). A shank 207 of the pellet 12*b* can include a recess 206 formed therein to allow attachment of one or more hooks or similar structure to the pellet. Thus, in some embodiments, a hook assembly (e.g., 180 in FIG. 6A) carrying one or more hooks or other engagement structure can be carried by the tail end of the pellet.

The gasket 210 can be sized and shaped to ensure that an airtight seal is provided between the gasket and the inner bore of the socket. In this manner, pressure is limited or prevented from "blow-by" beyond the head portion (e.g. it can prevent the blow-by from reaching the tail portion). Blow-by can otherwise lead to a loss in pressure, and thus a loss in velocity, as the pellet is expelled from the launcher. In the examples shown, groove 208 includes a recessed feature, such that protruding shoulders appear on each side of the groove, preventing movement of the gasket along the length of the pellet.

The type of seal or gasket used can vary. In the example shown in FIG. 13B, the seal is a 1 mm×5 mm Buna rubber, or a polybutadiene rubber synthetic rubber. In another example, the gasket is formed from silicone. Whichever type of material is used in the gasket, it creates an airtight seal that provides advantages to various propulsion systems. The seal functions well for pressure sources 50 that include a propellent (e.g., gunpowder) and compressed air. In each case, testing has demonstrated that the velocity of the pellet as it is propelled from the sockets has increased with the presence of a seal compared to a pellet without the presence of the seal or gasket. In addition, any undesirable particulates can be prevented from traveling onto the pellet or tether located downstream from the gasket.

In the example shown in FIGS. 6A and 6B, the pellet 12*a* can include a seal 66 that can be carried by the pellet. In this example, the seal is generally shaped as a disk and can be coupled to a far end of the head portion 15*a* of the pellet. The seal can be formed from a relatively pliable material, such as a felt or a fibrous material, or a polymeric material. The seal provides a number of advantages. It can serve to seal the socket upstream of the pellet, to avoid "blow-by," which can decrease the velocity at which the pellet is deployed from the socket. In some aspects, the felt or fibrous material can carry, or be coated or impregnated with, a lubricating material, to reduce friction between the seal and the socket within which the pellet travels.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

We claim:

1. An entangling projectile, comprising:

a pair of pellets and a tether connecting the pellets, the pellets each having:

a head portion, a tail portion and at least one gasket, carried by the head portion, the gaskets suitable to provide a sealed interface between the head portion of each pellet and a socket within which each pellet is fired from a launcher.

2. The projectile of claim 1, wherein the pellets have a maximum outer diameter and wherein the gaskets present an outer diameter, the outer diameters of the gaskets being greater than the maximum outer diameter of the pellets.

3. The projectile of claim 1, wherein the tether is attached to each pellet adjacent the tail end of each pellet.

4. The projectile of claim 1, wherein the gaskets are toroidal in shape and circumscribe an outer surface of each respective pellet.

5. The projectile of claim 4, further comprising a recess formed in the outer surface of each pellet, each respective gasket fitting at least partially within one of the recesses.

6. The projectile of claim 1, wherein the gaskets are disk-shaped.

7. The projectile of claim 6, wherein the head portion of each of the pellets presents an end surface area, and wherein each respective gasket is attached to the end surface area of the head portion of each pellet and presents an end surface area greater than the end surface area of the head portion.

8. The projectile of claim 1, further comprising a hook assembly, carried adjacent each tail portion of each pellet.

9. The projectile of claim 1, wherein the pellets each include a shank portion intermediate the head portion and the tail portion, the shank portion having a reduced diameter relative to the head portion of the respective pellet.

10. A system for launching an entangling projectile, comprising:

an entangling projectile, including a pair of pellets and a tether connecting the pellets, the pellets each having a head portion and a tail portion;

a projectile casing, including:

a pair of sockets, each socket sized to carry one of the pair of pellets;

a selectively activatable pressure source, carried by the projectile casing, the pressure source being capable of expelling the entangling projectile from the projectile casing toward a subject;

the head portion of each of the pellets carrying a gasket, the gasket suitable to provide a sealed interface between the head portion of the pellet and a socket within which the pellet is carried in the launcher.

11. The system of claim 10, wherein the pressure source comprises a cartridge blank carrying a propellant.

12. The system of claim 10, wherein the pressure source comprises a compressed gas cylinder.

13. The system of claim 10, wherein the tether is attached adjacent the tail portion of each of the pellets.

14. The system of claim 10, wherein each gasket is toroidal in shape and circumscribes an outer surface of the head portion of the at least one pellet.

15. The system of claim 14, further comprising a recess formed in the outer surface of the head portion of each pellet, each gasket fitting at least partially within the recess.

16. The system of claim 10, wherein the gasket is disk-shaped.

17. The system of claim 16, wherein the head portion of each of the pellets presents an end surface area, and wherein the gasket is attached to the end surface area of the head portion and presents an end surface area greater than the end surface area of the head portion.

18. The system of claim 10, further comprising a hook assembly, carried by the tail portion of pellets.

19. The system of claim 10, wherein the pellets each include a shank portion intermediate the head portion and the tail portion, the shank portion having a reduced diameter relative to the head portion.

20. The system of claim 10, wherein the gaskets are at least partially formed from a pliable material.

21. An entangling projectile, comprising:

a pair of pellets and a tether connecting the pellets, the pellets each having a head portion and a tail portion;

at least one gasket, carried by the head portion of at least one of the pellets, the gasket suitable to provide a sealed interface between the head portion of the at least one pellet and a socket within which the at least one pellet is fired from a launcher; and a hook assembly, carried adjacent the tail portion of the at least one of the pellets.

22. The projectile of claim 21, wherein the tether is attached to the at least one pellet adjacent the tail end of the at least one pellet.

23. The projectile of claim 21, further comprising a recess formed in the outer surface of the at least one pellet, the gasket fitting at least partially within the recess.

24. The projectile of claim 21, wherein the head portion of the at least one of the pellets presents an end surface area, and wherein the gasket is attached to the end surface area of the head portion and presents an end surface area greater than the end surface area of the head portion.

25. The projectile of claim 21, wherein the at least one of the pellets includes a shank portion intermediate the head portion and the tail portion, the shank portion having a reduced diameter relative to the head portion of the at least one of the pellets.

26. An entangling projectile, comprising:

a pair of pellets and a tether connecting the pellets, the pellets each having a head portion and a tail portion; and at least one gasket, carried by the head portion of at least one of the pellets, the gasket suitable to provide a sealed interface between the head portion of the at least one pellet and a socket within which the at least one pellet is fired from a launcher;

at least one of the pellets including a shank portion intermediate the head portion and the tail portion, the shank portion having a reduced diameter relative to the head portion of the at least one of the pellets.

27. The projectile of claim 26, wherein the tether is attached to the at least one pellet adjacent the tail end of the at least one pellet.

28. The projectile of claim 26, further comprising a recess formed in the outer surface of the at least one pellet, the gasket fitting at least partially within the recess.

29. The projectile of claim 26, wherein the head portion of the at least one of the pellets presents an end surface area, and wherein the gasket is attached to the end surface area of the head portion and presents an end surface area greater than the end surface area of the head portion.

30. The projectile of claim 26, further comprising a hook assembly, carried adjacent the tail portion of the at least one of the pellets.

* * * * *